US009498075B2

(12) United States Patent
Jones

(10) Patent No.: US 9,498,075 B2
(45) Date of Patent: Nov. 22, 2016

(54) GARMENT HANGER

(71) Applicant: Mainetti (UK) Limited, Scotland (GB)

(72) Inventor: Michael Jones, Denbighshire (GB)

(73) Assignee: Mainetti (UK) Limited (GB)

( * ) Notice: Subject to any disclaimer, the term of this patent is extended or adjusted under 35 U.S.C. 154(b) by 0 days.

(21) Appl. No.: 14/438,775

(22) PCT Filed: Oct. 24, 2013

(86) PCT No.: PCT/GB2013/052769

§ 371 (c)(1),
(2) Date: Apr. 28, 2015

(87) PCT Pub. No.: WO2014/064446

PCT Pub. Date: May 1, 2014

(65) Prior Publication Data

US 2015/0297011 A1 Oct. 22, 2015

(30) Foreign Application Priority Data

Oct. 26, 2012 (GB) ..... 1219297.7

(51) Int. Cl.
*A47G 25/14* (2006.01)
*A47G 25/48* (2006.01)

(52) U.S. Cl.
CPC ..... *A47G 25/1407* (2013.01); *A47G 25/14* (2013.01); *A47G 25/1435* (2013.01); *A47G 25/48* (2013.01)

(58) Field of Classification Search
CPC ..... A47G 25/14; A47G 25/1407; A47G 25/1435; A47G 25/48; A47G 25/1428
See application file for complete search history.

(56) References Cited

U.S. PATENT DOCUMENTS 1,710,296 A 4/1929 Clark
3,467,291 A * 9/1969 Phillips ..... A47G 25/32 223/85

(Continued)

FOREIGN PATENT DOCUMENTS

DE 29915631 U1 * 12/1999
GB 1569861 6/1980

(Continued)

OTHER PUBLICATIONS

International Search Report of PCT Application No. PCT/GB2013/052769, dated Jan. 23, 2014.

(Continued)

*Primary Examiner* — Ismael Izaguirre
(74) *Attorney, Agent, or Firm* — Jack Schwartz & Associates, PLLC

(57) ABSTRACT

A garment hanger is disclosed. The hanger has a hook and a body suspended below the hook. The body includes a garment supporting portion for supporting a garment and a display receiving portion for receiving a display member. A display member is also provided for attachment to the display receiving portion. The display portion includes retaining tabs, a flat front portion and side portions extending away from the front portion.

9 Claims, 8 Drawing Sheets

(56) References Cited

U.S. PATENT DOCUMENTS

| | | | | |
|---|---|---|---|---|
| 4,006,547 | A * | 2/1977 | Samuels | A47G 25/1407 223/85 |
| 5,649,651 | A * | 7/1997 | Lam | A47G 25/0607 223/85 |
| 5,687,887 | A * | 11/1997 | Bond | A47G 25/1435 223/85 |
| 7,198,182 | B1 * | 4/2007 | Schulman | A47G 25/1442 223/87 |
| 7,287,674 | B1 | 10/2007 | Sutton et al. | |
| 8,225,538 | B2 * | 7/2012 | Warren | A47G 25/1435 223/85 |
| 2005/0099303 | A1 | 5/2005 | Zuckerman | |
| 2007/0199963 | A1 | 8/2007 | Gouldson | |
| 2008/0035685 | A1 * | 2/2008 | Matkovich | A47G 25/1421 223/85 |
| 2008/0136598 | A1 * | 6/2008 | Chen | G06K 7/0008 340/10.1 |
| 2010/0237109 | A1 | 9/2010 | Gouldson | |

FOREIGN PATENT DOCUMENTS

| | | |
|---|---|---|
| GB | 2064472 | 6/1981 |
| GB | 2191393 | 12/1987 |
| GB | 2302800 | 2/1997 |
| GB | 2409806 | 7/2005 |
| GB | 2426188 | 11/2006 |
| GB | 2464115 | 4/2010 |
| GB | 2474329 | 4/2011 |

OTHER PUBLICATIONS

UK Search Report of UK Application No. GB1219297.7, dated Dec. 12, 2012.

* cited by examiner

GARMENT HANGER

The present invention relates to a garment hanger and relates particularly, but not exclusively, to a garment hanger for use by a retailer to display garments for sale.

It is well known and desirable for retailers to use colour within a store to differentiate sub-brands or departments. These sub-brands typically have their own house style and logo to differentiate a specific garment range or to entice a different target customer into that area. For example, subtle soft colour tones can be used in lingerie departments with clean elegant branding whereas a range of clothes for the younger consumer maybe bright, vibrant colours with a modern logo.

Garment hangers can be used in different colours with different logos to help with this 'shop in shop' look.

Making hangers in various colours with different prints is a costly process as all the changes in colour and print creates down time for machinery. It is much more cost effective to make the hangers in one colour (normally black as recycled material can be used) and with only one logo or print option.

As more and more hangers are reused there is more a need to be able to rejuvenate the hanger. Sometimes the print on the hanger is scratched, sometimes a retailer changes their logo or changes the colour of their brand. It is therefore desirable to be able to change a hanger during the recycling/reuse process to accommodate this requirement. There are further complications for the hanger in the reuse environment such as the hooks becoming loose or corrosion over time. A further desirable feature is to be able to replace the hook during this reconditioning process.

There have been unsatisfactory attempts to find solutions to these problems. For example, GB2191393 discloses a hanger sold as a 'Kit of Parts'. This goes someway to solving one of the problems set out above but if a logo used on the hanger changes the entire central area and hook must be replaced (even if the hook is perfectly fine). It is also quite costly to make this entire portion of that hanger in a coloured plastic.

FR1356509 discloses a hanger with a front plaque or plate that covers the entire front face that can be changed. There are many hangers in existence with this type of replaceable front face but the problem is that even if the front face is coloured it is hidden by the hanger in front when it is hung on a rail.

Preferred embodiments of the present invention seek to overcome the above described disadvantages of the prior art.

According to the present invention there is provided a garment hanger comprising:

at least one suspension device for suspending the hanger from a support;

at least one body suspended below the suspension device and formed from at least one plastic material, the body including at least one garment supporting portion for supporting a garment thereon, and a display receiving portion for receiving a display member and located adjacent said suspension device; and at least one display member for attachment to a respective display receiving portion and formed from at least one plastic material, the or each display member including at least one first retainer for removably retaining the display member in engagement with the display receiving portion, a front portion having a substantially planar front surface for receiving display information, and side portions extending from said front portion, the side portions having side surfaces extending away from said front surface, wherein when said display member is attached to said display receiving portion, said front and side surfaces of said display member and adjacent surfaces of said body form a substantially continuous surface of the garment hanger.

By providing a display member that attaches to the body of hanger and has side portions, as well as the front portion, that extend away from the front surface and is therefore visible from the front and the side provides solutions to the problems with the prior art set out above. In particular, the side portions ensure that when hangers are in a row on a rail the differently coloured plastic is visible when viewed from the front and from the side thereby allowing the use of colour on the hanger to be clearly visible from the majority of angles that a customer views a garment on a rail, that is, from the front and to the side. Even when hangers are closely packed together on a rail, the colouring of the display member will be clearly visible from the majority of angles. Furthermore, the angles that the display member will not be visible are primarily from the rear and in many cases, for example where shirts, blouses and jackets are hung on hangers, where the rear of the hanger is not visible anyway.

Furthermore, it is the front and side parts that are exposed and most likely to become damaged during use. As a result, the replacement display member can be used to refresh a hanger that has had significant use and the display portion has become scratched. As a result, the hanger body can continue to be reused without the need to replace the entire hanger or the central area and hook. As a result, it is possible to provide more consistent and more visible colour for the purposes of "store in store" branding.

In a preferred embodiment the suspension device comprises a hook portion for hanging the hanger on the support.

In another preferred embodiment the hook portion comprises a metal hook.

In a further preferred embodiment at least one suspension device further comprises at least one second retainer for removably retaining the suspension device in engagement with said body.

By providing a removable suspension device the advantages provided that the hooks can be changed as desired and if a hook becomes damaged, for example, a metal hook may begin to freely rotate, this can be replaced.

In a preferred embodiment at least one said second retainer comprises flexible tabs with retaining teeth for anchoring the suspension device in respective retaining apertures in said body portion.

In another preferred embodiment the garment support portion comprises one or more of: clips; arms of the hanger; and at least one substantially horizontal support bar.

In a further preferred embodiment at least one said display member further comprises flexible tabs with retaining teeth for anchoring the suspension device in respective retaining apertures in said body portion.

The hanger may further comprise at least one security device.

In a preferred embodiment the security device at attached to said body.

In another preferred embodiment the security device comprises at least one RFID tag.

By providing an RFID tag that is attached to the body of the hanger, the advantage is provided that the RFID tag can be very easily added to a garment hanger but is hidden by the branding area. This allows the security device to be hidden so as not to immediately alert potential thieves to its presence whilst making it easy to install. In examples of the prior art where RFID tags have to be hidden inside a hanger it can be difficult to locate them on the inside of a portion of the hanger that has a narrow cross-section. It should also be noted that the use of this position for the RFID tag allows for scanning of the tag during logistics, tracking the garment during transit and can be used for stock control and store replenishment purposes.

Preferred embodiments of the present invention will now be described by way of example only, and not in any limitative sense, with reference to the accompanying drawings in which.

Figure 1:
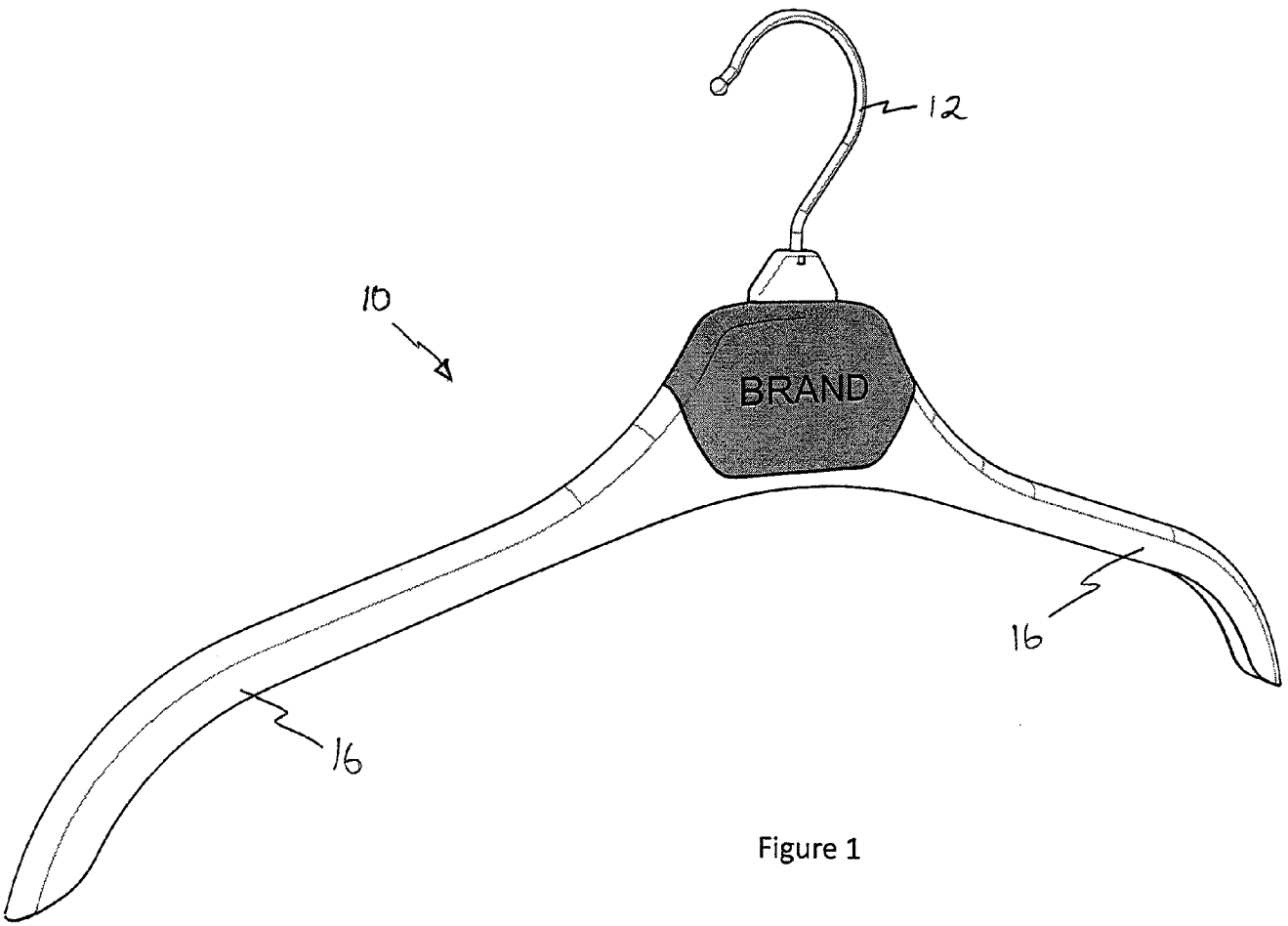
FIG. 1 is a perspective view of a garment hanger of the present invention.
Figure 4:
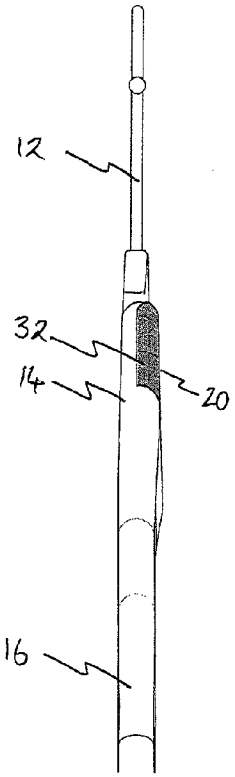
FIGS. 2, 3 and 4 are front, plan and side views respectively of the hanger of FIG. 1.
Figure 3:
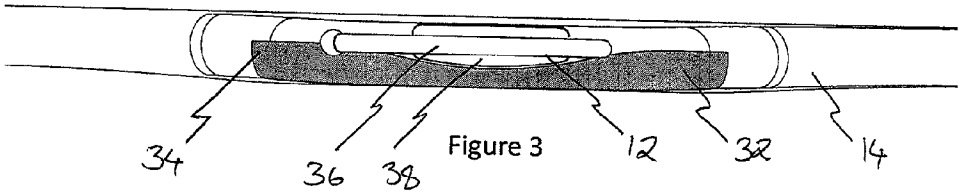
Figure 2:
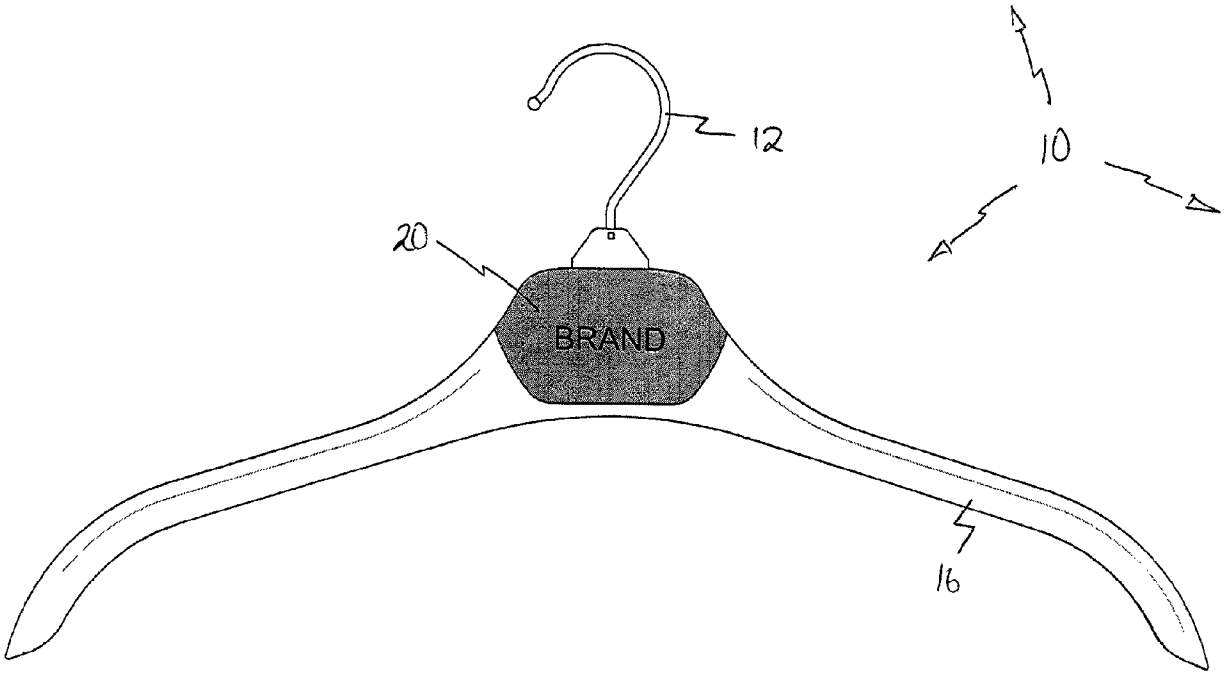
Figure 6:
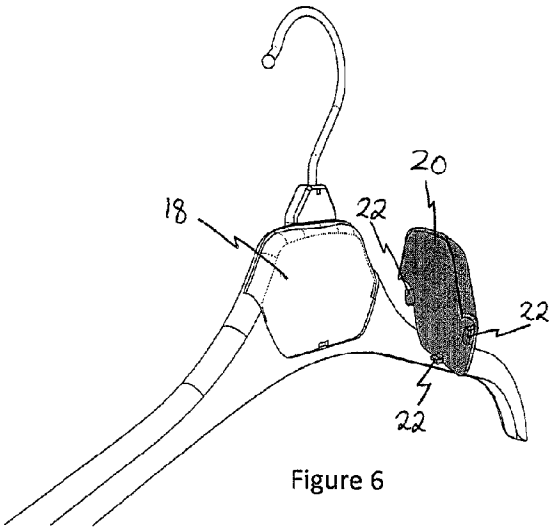
FIGS. 5 and 6 are perspective views of the hanger of FIG. 1 with a display member removed.
Figure 5:
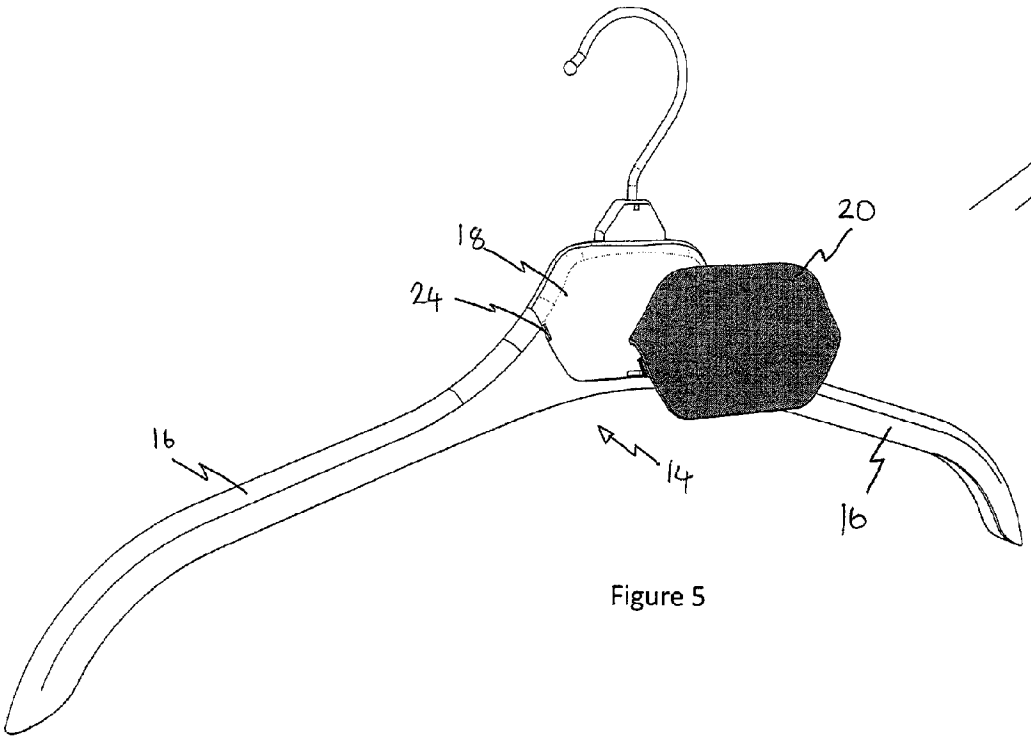
Figure 8:
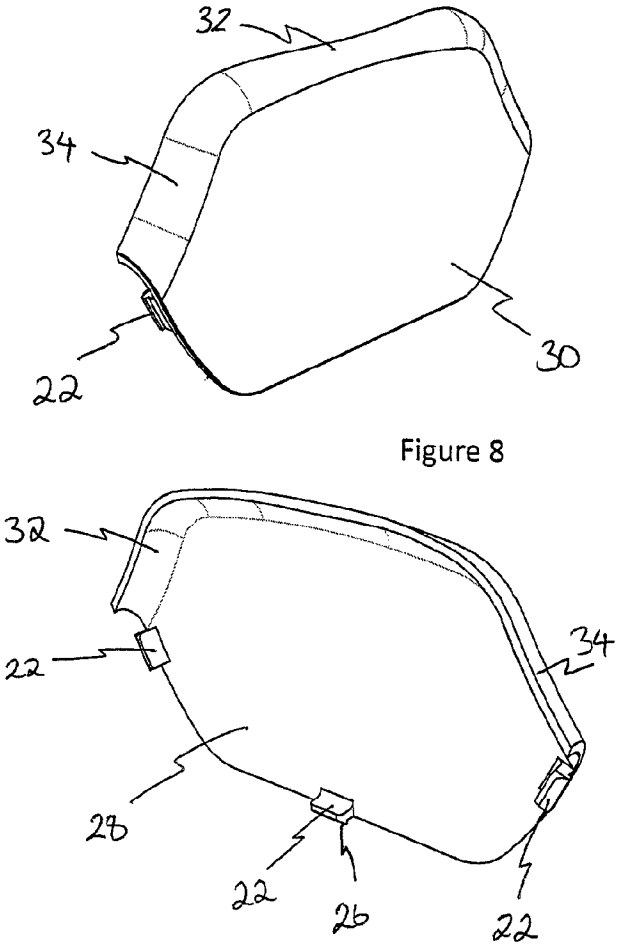
FIGS. 7 and 8 are isometric and perspective views of the display member used in the hanger of FIG. 1.
Figure 7:
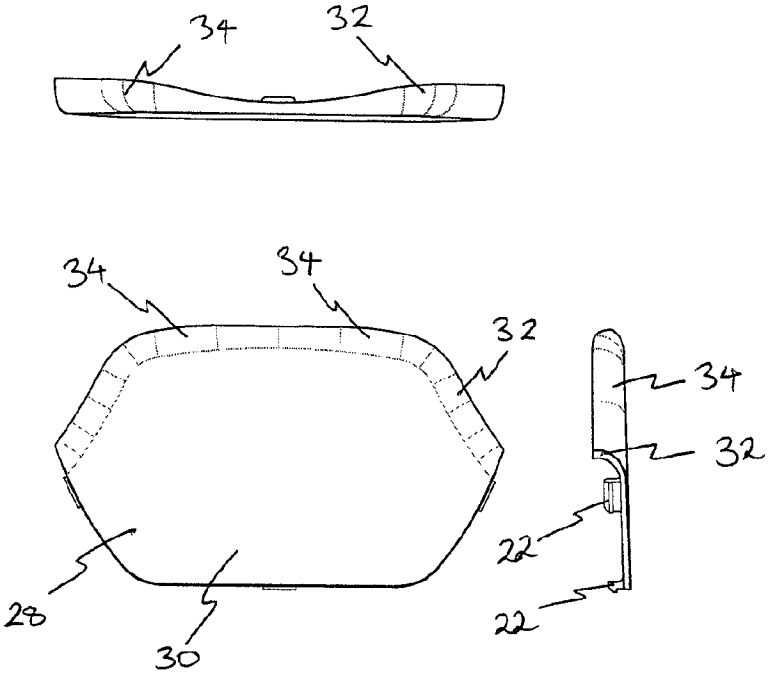

Referring to FIGS. 1 to 8, a garment hanger 10 has one or more suspension devices in the form of hook 12 that are used for suspending the hanger from a support such as a rail (not shown) in a store. The hanger 10 also has a body 14 that when in use is suspended below the hook 12 and in the case of the hanger shown in FIGS. 1 to 8 is a tops hanger for hanging garments such as shirts, blouses, T-shirts and light weight knit wear. The body 14 includes a garment supporting portion in the form of arms 16 which bare the weight of a garment hung on the hanger 10. The body also has a display receiving portion 18 that receives a display member 20 and which is located adjacent the hook 12 in the central area of the body 14, generally referred to as the neck, label or branding area.

The display member 20 is formed separately from the body and can be removably attached to the display receiving portion 18 of body 14. The display member 20 is retained in engagement with display receiving portion 18 by the use of flexible retaining tabs 22 that engage apertures 24 in display receiving portion 18. Each tab 22 has a retaining tooth or ridge 26 which catches on an inner edge of aperture 24 making accidental removal of the display member 20 unlikely to occur. The flexing in flexible retaining tabs results either from a flexing in the length of the tab, the junction between the tab and the remainder of the display member or in the flexing of the display member, particularly the front portion.

The display member 20 has a front portion 28 that has a front surface 30 to which printing or other markings, such as embossing, may be applied. The display member 20 also has side portions 32 that have side surfaces 34 that extend away from the plane of the front surface 30 and in use fold around the sides so as to form a continuous surface with the adjacent portions of the body 14.

Figure 14:
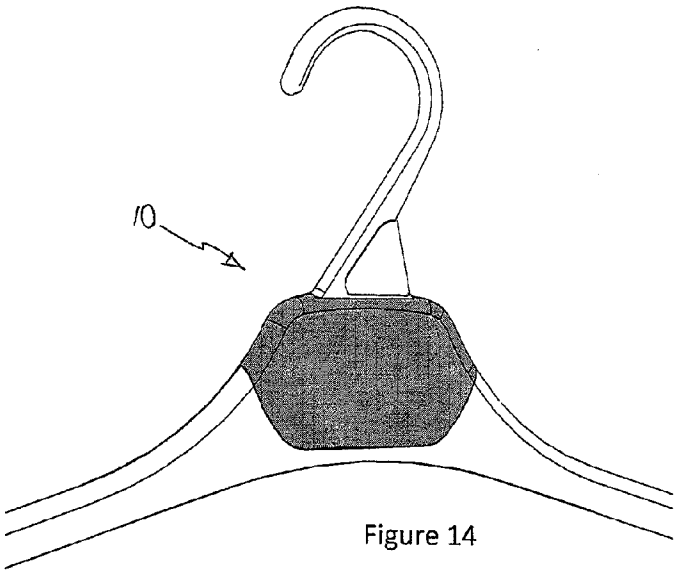
FIG. 14 is a perspective view of the hanger of FIG. 1 with an alternative suspension portion.
Figure 13:
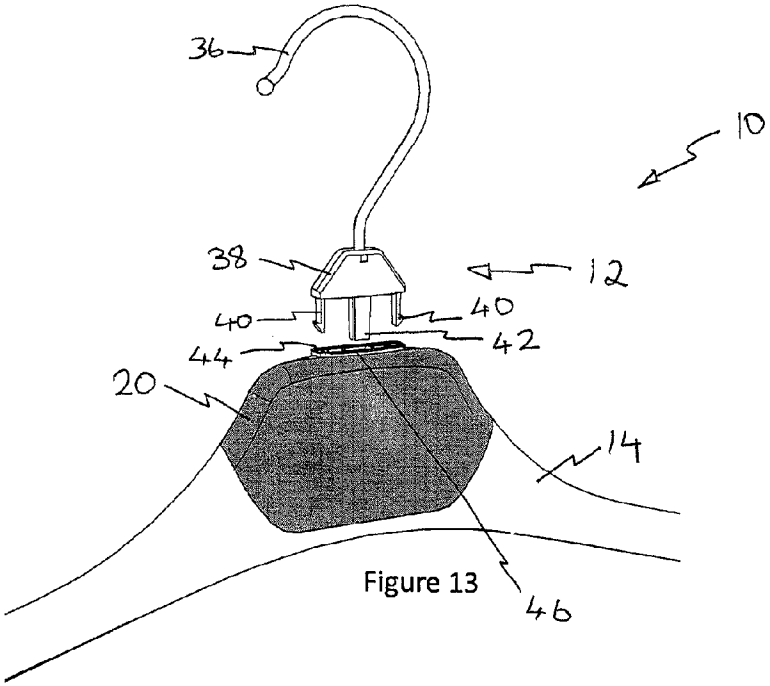
FIG. 13 is partially exploded view of the hanger of FIG. 1.

Referring to FIGS. 13 and 14, the suspension device or hook 12 is shown as being a removable hook including a metal hook portion 36 and a plastic retainer 38 having fixing legs 40 and a guide post 42 the fixing legs and guide post 42 are received in respective apertures 44 and 46 this allows the hook 12 to be replaced with, for example, an all plastic hook shown in FIG. 14. Alternatively, in the event of damage the hook may be replaced with a new one.

Figure 12:
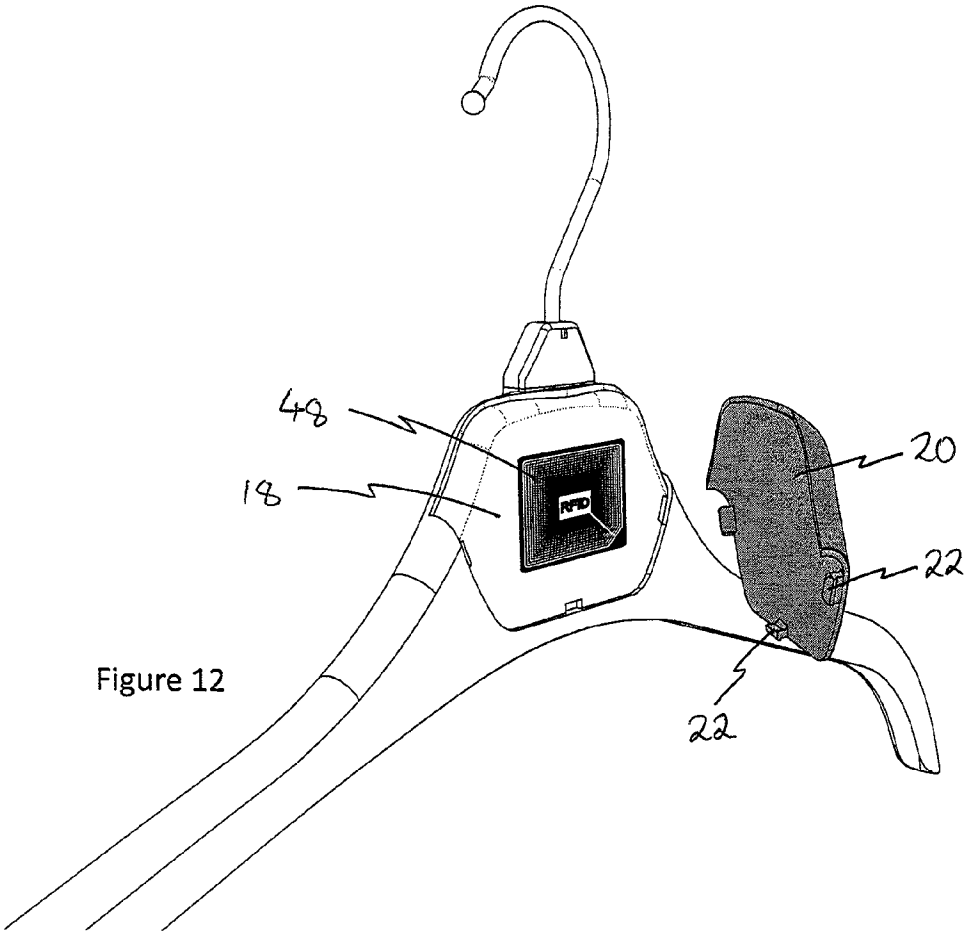
FIG. 12 is a perspective view of the hanger of FIG. 1 including a security device.

With reference to FIG. 12, the display member 20 can be used to hide a security device, in the form of RFID tag 48, which is stuck to display receiving portion 18. It is significantly easier to attach the RFID tag to this surface and cover it with the display member than to insert such a tag into the space between the front and rear surfaces of the body 14 where a U-shaped cross-section is used, such as in the hanger in FIG. 12.

Use of the apparatus for the present invention will now be described. A large retail store may sell a large range of its own clothing goods under a variety of brands or may have different sections dealing with different types of clothes for example, menswear, womenwear, sportswear, formal wear etc. Such a retailer may wish to define these different brands or departments by the use of differently coloured hangers. For a lot of clothes it is the central area that is prominent when garments are hung on the hangers and the garments and hangers are on display on a rail. By using the present invention a retailer can take advantage of the low cost of producing black plastic hangers in large numbers for the hanger bodies 16 and vary the colour and branding on the display members 20. As a result, each department or brand appears to have a different coloured hanger and brands and departments are more clearly defined. Because coloured plastic is relatively expensive, compared to the black plastic of the body, the smaller runs of coloured plastic can be justified for making the display members only without significantly increasing the overall cost of production. Furthermore, the reuse of an old hanger can continue for longer when it can be refreshed with a new display member.

Figure 10:
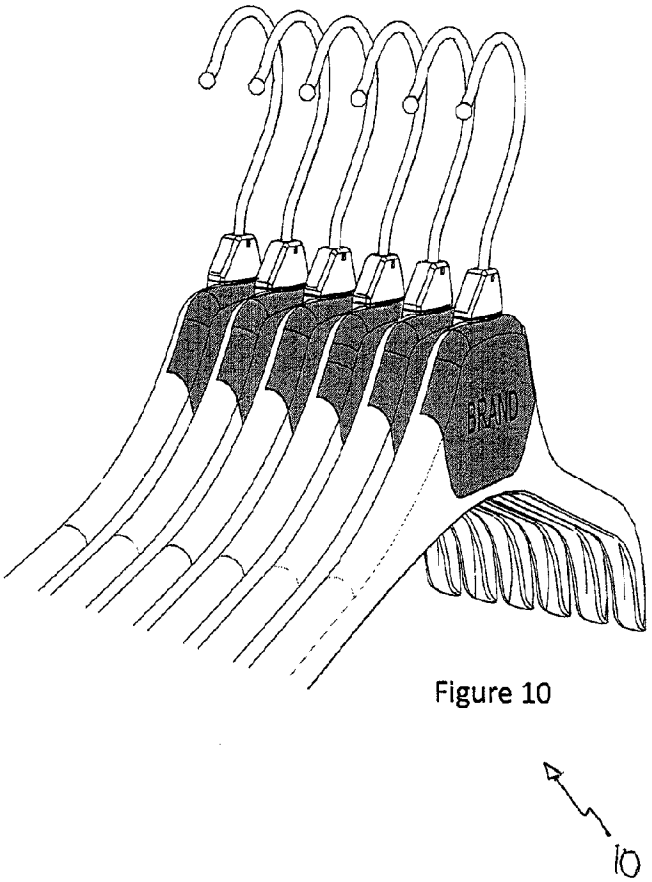
FIG. 10 is a perspective view of several hangers of FIG. 1.
Figure 9:
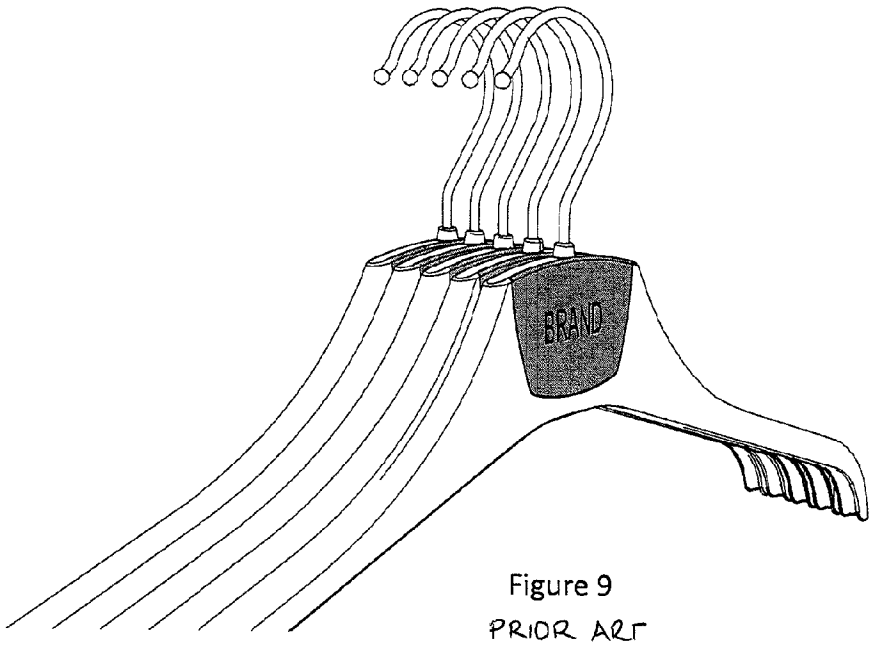
Figure 9 PRIOR ART
FIG. 9 is a perspective view of a series of hangers of the prior art.

As shown in FIG. 10 when several hangers of the present invention are lined up together and viewed from an angle of more than 45 degrees from the front view, the coloured portion of the display member is still clearly visible. If the viewer were to move any further round the garment would begin to obscure the view of the hanger. In comparison, FIG. 9 shows an example of the prior art where an equivalent display member is only present on the front surface of the hanger body and would not be at all visible from the side. Furthermore, if a display member 20 becomes scratched, and this is the area most likely to become scratched since it is not protected by a garment, this can be easily replaced and it is the side surfaces 34 of the display member 20 that are most vulnerable. In the prior art shown in FIG. 9 if this portion of the hanger becomes scuffed it cannot be refreshed by replacement of the display member.

Figure 11:
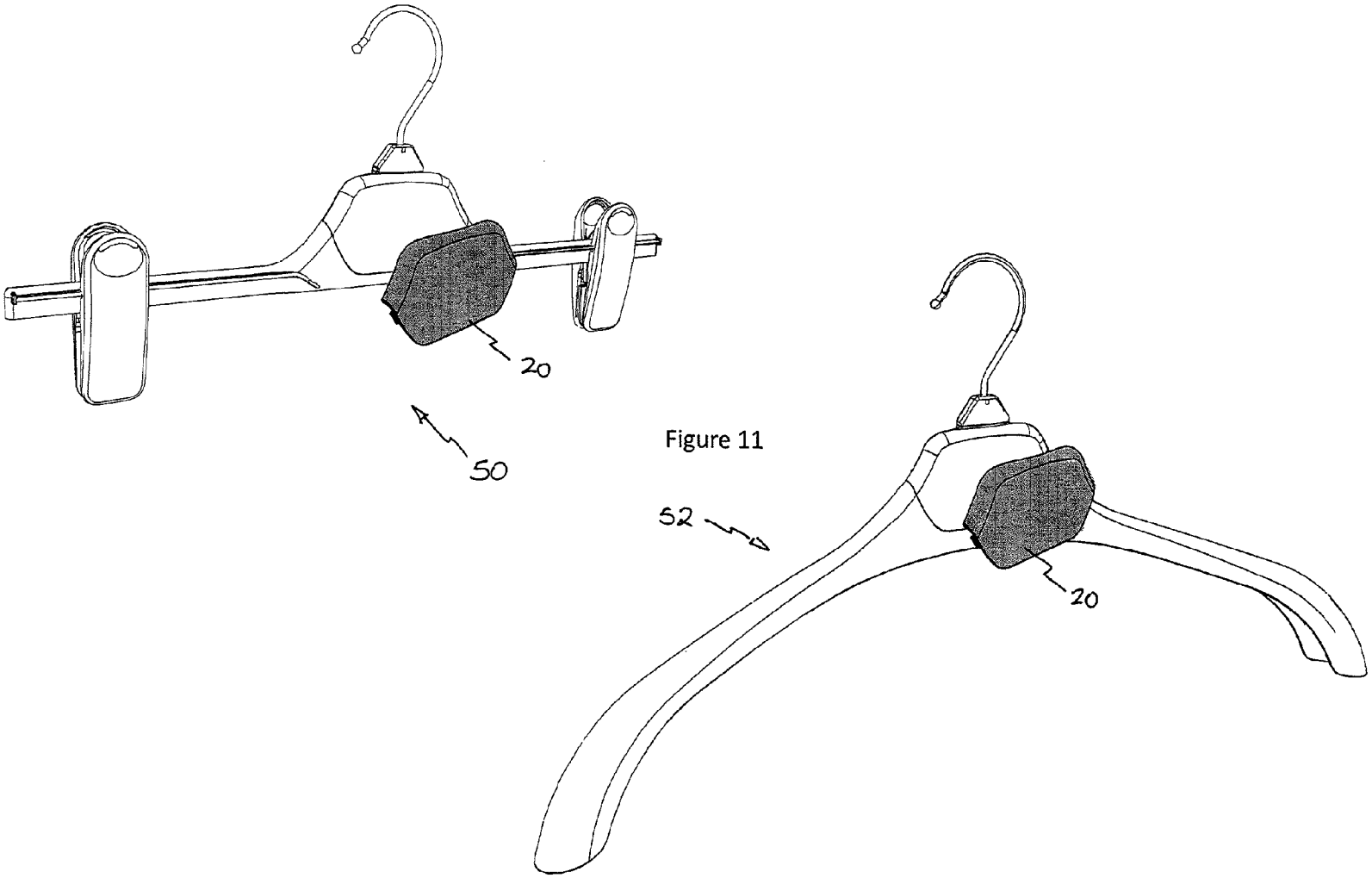
FIG. 11 is a pair of perspective views of alternative embodiments of the present invention.

Referring to FIG. 11, this shows that the same display member 20 can be used across different hanger types with hanger 50 being a clip hanger and hanger 52 being a jacket hanger. As a result, it can be seen that the volume of a single colour of display member 20 can be used across different hanger types meaning that reasonably large volumes of display members can be produced thereby reducing overall production costs.

It will be appreciated by persons skilled in the art that the above embodiments have been described by way of example only and not in any limitative sense, and that various alterations and modifications are possible without departure from the scope of the invention as defined by the appended claims.

The invention claimed is:

1. A garment hanger comprising:

at least one suspension device for suspending the garment hanger from a support;

at least one body suspended below the at least one suspension device and formed from at least one plastic material, the at least one body including at least one garment supporting portion for supporting a garment thereon, and a display receiving portion located adjacent said at least one suspension device; and at least one display member for attachment to the display receiving portion and formed from at least one plastic material, the at least one display member including at least one first retainer for removably retaining the at least one display member in engagement with the display receiving portion, a front portion having a substantially planar front surface for receiving display information, and side portions extending from said front portion, the side portions having side surfaces extending away from said front surface of said front portion, wherein, when said at least one display member is attached to said display receiving portion, said front and side surfaces of said at least one display member and adjacent surfaces of said at least one body form a substantially continuous surface of the garment hanger.

2. The garment hanger according to claim 1, wherein said at least one suspension device comprises a hook portion for hanging the garment hanger on the support.

3. The garment hanger according to claim 2, wherein said hook portion comprises a metal hook.

4. The garment hanger according to claim 1, wherein said at least one suspension device further comprises at least one second retainer for removably retaining the at least one suspension device in engagement with said at least one body.

5. The garment hanger according to claim 4, wherein said at least one second retainer comprises flexible tabs with retaining teeth for anchoring the at least one suspension device in respective retaining apertures in said at least one body.

6. The garment hanger according to claim 1, wherein said at least one garment supporting portion comprises one or more of: clips arms of the hanger; and at least one substantially horizontal support bar.

7. The garment hanger according to claim 1, wherein said at least one display member further comprises flexible tabs with retaining teeth for anchoring the at least one suspension device in respective retaining apertures in said body portion.

8. The garment hanger according to claim 1, further comprising at least one security device attached to said at least one body.

9. The garment hanger according to claim 8, wherein said at least one security device comprises at least one RFID tag.

* * * * *